US007038576B2

(12) United States Patent
Di Giovanni et al.

(10) Patent No.: US 7,038,576 B2
(45) Date of Patent: May 2, 2006

(54) ELECTROPNEUMATIC HORN

(75) Inventors: Corrado Di Giovanni, Grumolo Delle Abbaddesse (IT); Luigi Filippo Beltrame, Arcugnano (IT)

(73) Assignee: Stebel SPA, Grisignano Di Zocco (VI) (IT)

( * ) Notice: Subject to any disclaimer, the term of this patent is extended or adjusted under 35 U.S.C. 154(b) by 200 days.

(21) Appl. No.: 10/489,825

(22) PCT Filed: Aug. 9, 2002

(86) PCT No.: PCT/EP02/08945

§ 371 (c)(1),
(2), (4) Date: Mar. 17, 2004

(87) PCT Pub. No.: WO03/056545

PCT Pub. Date: Jul. 10, 2003

(65) Prior Publication Data

US 2004/0246110 A1 Dec. 9, 2004

(30) Foreign Application Priority Data

Dec. 29, 2001 (IT) ..... VI2001A0270

(51) Int. Cl.
*G08B 3/00* (2006.01)

(52) U.S. Cl. ..... 340/404.1; 116/137 R; 116/139; 340/388.1; 340/388.4

(58) Field of Classification Search ..... 340/388.1, 340/384.1, 388.3, 388.4, 391.1, 404.1; 116/137 R, 116/138, 139, 142 R, 145, 142 FP, 142 FV, 116/137 A
See application file for complete search history.

(56) References Cited

U.S. PATENT DOCUMENTS

| | | | | |
|---|---|---|---|---|
| 1,730,192 | A | 10/1929 | CritchField | |
| 1,841,535 | A * | 1/1932 | Hueber et al. | 116/142 R |
| 1,901,187 | A * | 3/1933 | Osborne | 116/137 R |
| 3,124,098 | A * | 3/1964 | Thoben | 116/142 R |
| 3,846,792 | A * | 11/1974 | Haigh | 340/384.73 |
| 3,886,546 | A * | 5/1975 | Ueda | 340/388.7 |
| 4,007,703 | A | 2/1977 | Frigo | 116/142 FP |
| 4,314,522 | A | 2/1982 | Frigo | 116/142 R |
| 4,796,009 | A * | 1/1989 | Biersach | 340/388.4 |
| 5,263,435 | A * | 11/1993 | Takahashi | 116/142 R |
| 6,294,984 | B1 * | 9/2001 | Meister | 340/404.1 |
| 6,796,265 | B1 * | 9/2004 | Dexter et al. | 116/137 R |

* cited by examiner

*Primary Examiner*—Brent A. Swarthout
(74) *Attorney, Agent, or Firm*—Dykema Gossett PLLC

(57) ABSTRACT

An electropneumatic acoustic horn is disclosed, comprising an electric compressor unit for generating compressed air and a sound wave generator comprising at least an acoustic chamber associated to at least a volute wound acoustic duct adapted to propagate the produced sound to the outside. Air channelling means put the compressor unit in communication with each acoustic chamber. The compressor unit and the sound wave generator are mechanically connected in a removable way by fitting slidingly a collar.

21 Claims, 5 Drawing Sheets

11°
6
33
29
31(32)
11°

29
6
33
31
32

4
17a
6
5
42
13(14)
23(24)
25(26)
33
29
1°
31(32)
1°
21(22)
34
35
3
19(20)
27(28)

2
1

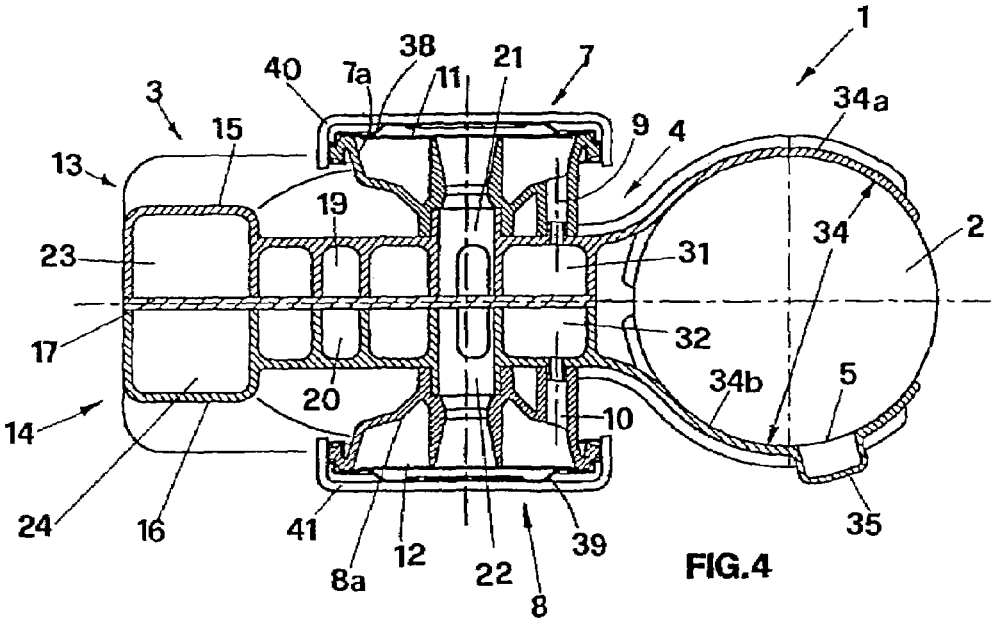
FIG.4
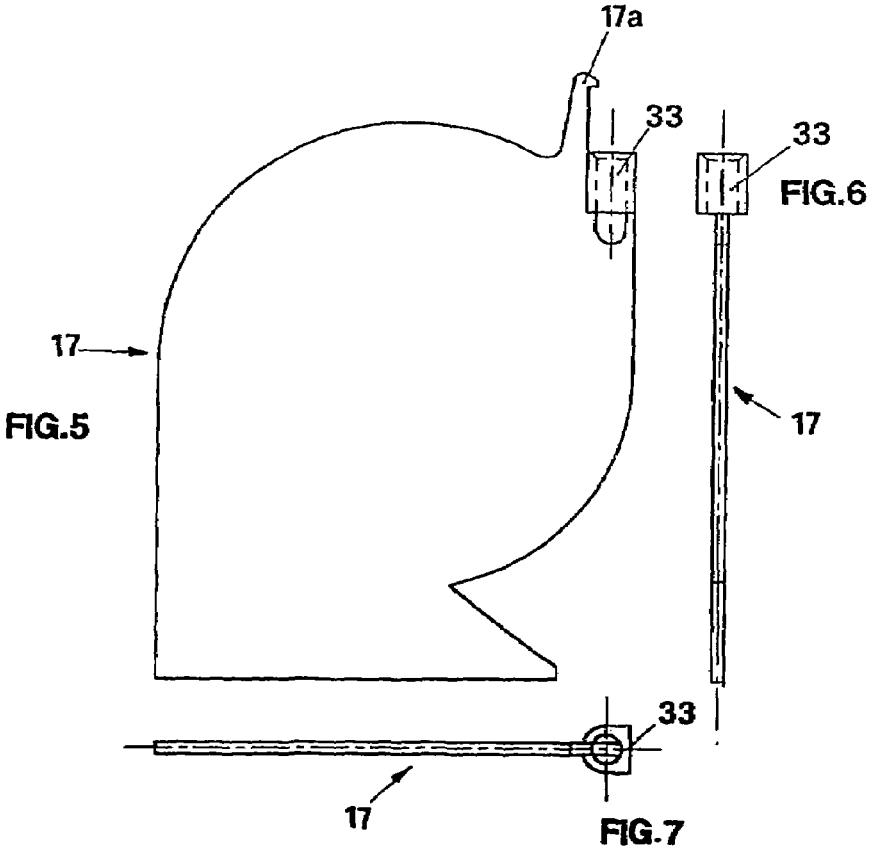
FIG.5
FIG.6
FIG.7

ELECTROPNEUMATIC HORN

BACKGROUND OF THE INVENTION

The present invention relates to an electropneumatic horn particularly adapted to equip two- and four-wheeled motor vehicles.

The electropneumatic horns of the prior art comprise a generator of sound waves including one or more acoustic units, connected to an electric compressor by ducts for air passage to generate a mono, bi o tri tonal tuned sound according to the number of acoustic units.

More particularly the acoustic units consist of a straight exponential duct of a length proportional to the frequency to be reproduced, inserted in an acoustic chamber in which a membrane free to move with a reciprocating motion is arranged.

The straight duct comprises a first stretch with generally constant section, provided with an inlet mouth for the sound signal generated by the oscillating membrane and a second stretch having a section varying with a generally conic exponential law ending with an outlet mouth for the amplified sound signal.

The membrane is properly stretched in a calibration phase by deformation against said membrane of a metal member referred to as bottom and applied to the shape of chamber body, in such a way to generate a sound with predetermined acoustic pressure.

In a different constructional version of the prior art the acoustic units are two and the corresponding ducts are volute wound and juxtaposed to limit the overall dimensions of the horn.

As already stated said acoustic horns and more particularly those with a straight acoustic units, equip motor vehicles and are generally installed in the engine compartments.

Acoustic horns with different features are available on the market, mainly classified according to the number of acoustic units, generally one to maximum three for the tuned sound, and according to the frequency that each unit should reproduce.

The need to optimise space and reduce dimensions of every element of the motor vehicle, led to reduce as much as possible the dimensions of the acoustic horns by miniaturization of the compressor assembly and the assembly comprising the acoustic units.

The solutions proposed up to now did not lead to great results, mainly in view of the correlation existing between the required sound frequency and required duct lengths, as well as the number of acoustic units anyway indispensable to reproduce simultaneously more frequencies.

With regard to installation of said acoustic horns, the compressor and the acoustic units are individually anchored to opposite supports through corresponding fastening members.

The compressor is then connected to each acoustic unit through a rubber duct provided with deviations allowing to convey compressed air in each acoustic chamber of the acoustic units.

A first drawback of such horns consists of the assembling complexity in the installation phase because bracketing of two or more components corresponding to the compressor and the acoustic units is required.

Another drawback consists in that the connection between each acoustic unit and the compressor is difficult and time consuming and does not warrant when improperly effected, instantaneousness and contemporaneousness of sound of the acoustic units.

As a matter of fact it is often impossible to carry out a correct assembly, more particularly with regard to the air connection between compressor and sound wave generator, thus making impossible to mount in limited space several components divided from each other but at the same time requiring to be installed close to each other to obtain sound instantaneousness and with the acoustic ducts being equidistant from the compressor to warrant contemporaneousness of sound.

In order to remove this drawback electromagnetic horns are widely used, warranting a good response to actuation and having a compact structure as well.

However, the assembling phase of said electromagnetic horns requires the use of special brackets, which are essential for their operation and have the drawback of increasing the overall dimensions of the assembly.

SUMMARY OF THE INVENTION

Object of the present invention is to overcome the above mentioned drawbacks.

More particularly a first object of the invention is to provide an electropneumatic horn of a more compact structure relative to the electropneumatic horns of the prior art.

Another object of the invention is to provide an electropneumatic horn reducing the assembling complexity relative to equivalent electropneumatic horns of the prior art.

A further object of the invention is to provide an electropneumatic horn allowing quick disassemble operations in case of mainteinance work.

It is then another object of the invention to provide an acoustic horn that in view of its features may be a valid alternative but with greater acoustic power to the electromagnetic horns.

A further object of the invention is to provide an acoustic horn having better features of sound instantaneousness and contemporaneousness relative to known electropneumatic horns, said the features being comparable to those of the electromagnetic horns.

A last but not least object of the invention is to provide an electropneumatic horn that may be a valid alternative to the electromagnetic horns in view of its greater reliability, more particularly as to resistance to an uninterrupted sound emission and reliability in the sense of product useful life.

Said objects are attained by an electropneumatic horn that according to the wording of the main claim comprises:

- at least a compressor unit provided with at least an air suction inlet from outside ambient and at least an outlet of compressed air;
- a sound wave generator comprising at least an acoustic chamber provided with at least an inlet for entry of pressurised air in which there is an elastic membrane for sound generation and at least a volute wound acoustic duct defined between an outer shell and a diaphragm, said acoustic duct communicating with said acoustic chamber and being adapted to propagate to the outside the sound generated by said membrane;
- air channelling means adapted to put said outlet of the compressor unit in communication with said inlet of the acoustic chamber;

and wherein said at least a compressor unit and said sound wave generator are mechanically connected in a removable way by fitting slidingly a collar.

According to a preferred embodiment the sound wave generator comprises two acoustic ducts defined between two opposite shells between which a diaphragm is interposed, a collar portion being made integral with each shell.

Said collar is also provided with a labyrinth suction duct putting the compressor suction inlet in communication with the outside.

The channelling means comprise an injector being part of the compressor and arranged after the outlet and coupled to a duct made in the diaphragm by snapping.

Said duct is in communication with two intermediate chambers defined in the sound wave generator, the opening communicating with the corresponding acoustic chamber being defined in each intermediate chamber.

In a different embodiment the sound wave generator comprises a single acoustic duct defined between a shell and a diaphragm while a portion of the collar is made integral with the shell and another portion with the diaphragm.

In both embodiments the acoustic horn comprises fastening means consisting of a single projecting element made in the compressor body for connection to the support structure.

Advantageously the acoustic horn of the invention may be supplied as a kit comprising a compressor unit and a sound wave generator that are coupled through the collar and therefore may be used to equip two and four wheeled vehicles with a simple assembling operation of the two main parts by snapping, namely generator and compressor, by the user.

Still advantageously, the compact structure of the acoustic horn minimizes the paths of the compressed air flows from the compressor to the acoustic chambers thus increasing the performance as to sound instantaneousness and contemporaneousness when more acoustic ducts are provided.

Also advantageously the compact structure of the acoustic horn allows more favourable installations for sound propagation from the vehicles, still respecting the minimum values for the type approval, more particularly in comparison with the electromagnetic horn of substantially less acoustic power.

BRIEF DESCRIPTION OF THE INVENTION

The foregoing objects will be better understood by reading the following description of preferred embodiments given as an illustrative but not limiting example, having reference to the accompanying sheets of drawing in which:

FIG. 4 is a sectional view of the acoustic horn of FIG. 1 taken along line I—I;

FIG. 5 is a side view of the diaphragm of the acoustic horn of FIG. 1;

FIG. 6 is a side view of the diaphragm of FIG. 5;

FIG. 7 is a top view of the diaphragm of FIG. 5;

DESCRIPTION OF THE INVENTION

Figures 1, 2, 3:
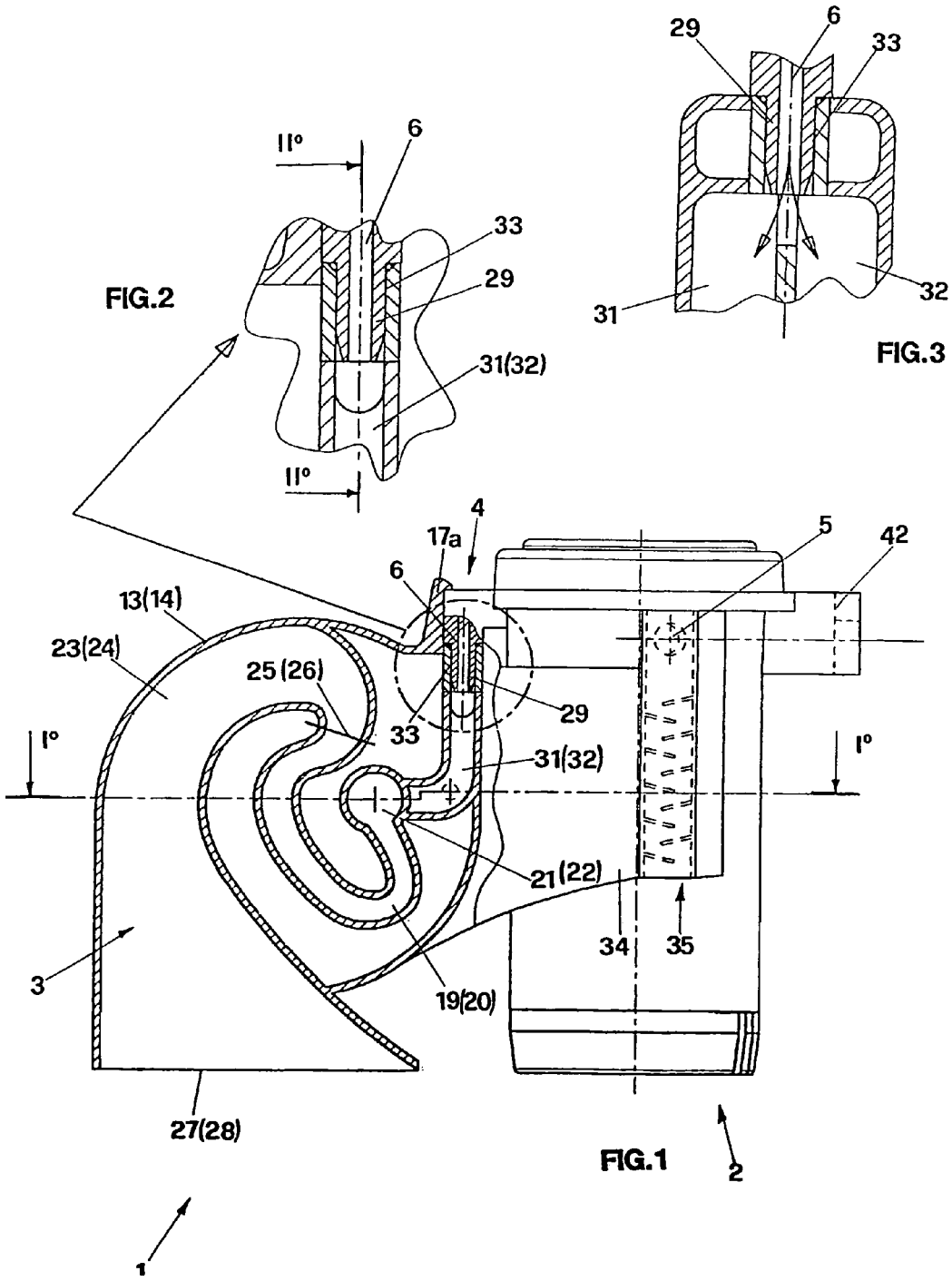
FIG. 1 is partially sectioned side view of the acoustic horn of the invention.
FIG. 2 is an enlarged view of a detail of the channelling means of FIG. 1.
FIG. 3 is a sectional view of the detail of FIG. 2 taken along line II—II.
Figure 9:
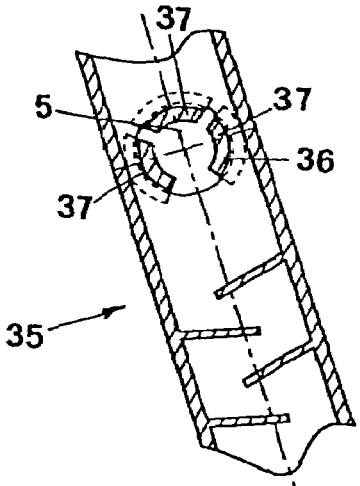
FIG. 9 is a sectional side view taken along line VIII—VIII of FIG. 8.
Figure 8:
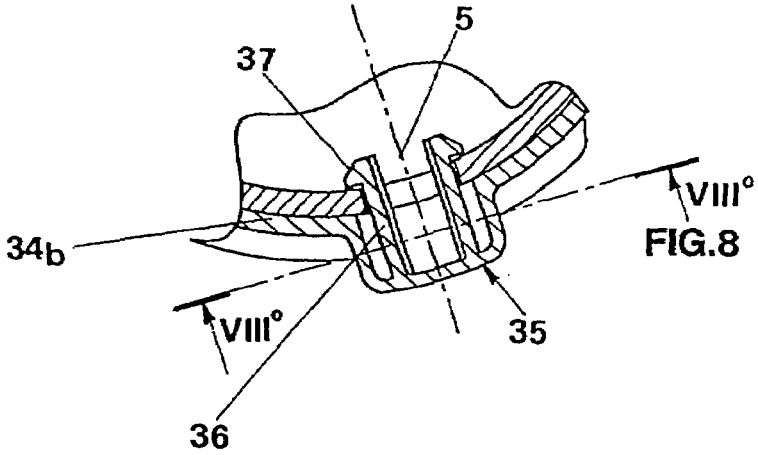
FIG. 8 is a sectional view of the detail of FIG. 4.

The acoustic horn of the invention is shown in FIG. 1 where it is generally indicated with numeral 1.

The horn comprises a compressor unit 2, a sound wave generator 3 and air channelling means 4 adapted to put the compressor 2 in communication with the sound wave generator 3.

More particularly the compressor unit 2 is provided with a suction inlet 5 from which air from outside is sucked, and an outlet 6 for the compressed air.

Proper elements of connection to the power supply, not shown in the drawings for sake of simplicity, are provided in the body of the compressor 2 and are generally arranged in its lower part.

With regard now to the sound wave generator 3, it comprises two acoustic chambers indicated with numerals 7 and 8 in FIG. 4 respectively, each chamber being provided with an opening 9, 10, for introduction of pressurised air.

In each acoustic chamber 7, 8, there is an elastic membrane 11, 12, for sound generation when the membrane is being vibrated by the compressed air coming from the compressor 2.

A volute wound acoustic duct 13, 14 is associated to each acoustic chamber 7, 8 and defined between an outer shell 15, 16 and a diaphragm 17 common to both acoustic duct 13, 14 and interposed between said shells 15, 16.

Each acoustic duct 13, 14 has a first stretch with generally constant section 19, 20 provided with an inlet 21, 22 communicating with the acoustic chamber 7, 8.

The first constant section stretch 19, 20 of the acoustic duct 13, 14 is connected to a second stretch 23, 24 at the point indicated with numerals 25, 26 in FIG. 1 and has a section varying with a generally conic exponential law ending with an outlet 27, 28 for sound propagation to the outside.

It is known that the configuration of each acoustic duct 13, 14 is consistent with the frequency to be obtained and in this case to obtain a tuned bi-tonal sound.

With regard now to the channelling means 4, they put the outlet 6 of the compressor 2 in communication with openings 9, 10 for introduction of pressurized air into the acoustic chambers 7, 8.

Said channelling means 4, comprise:

- an injector 29 belonging to the compressor 2 and arranged after the compressor outlet 6;
- two intermediate chambers 31, 32 defined in the sound wave generator 3 where each intermediate chamber 31, 32 defines the opening 9, 10 of connection with the corresponding acoustic chamber 7, 8;
- a duct 33 made in the diaphragm 17 communicating with the intermediate chambers 31, 32 and coupled to the injector 29 as shown in the details of FIGS. 2 and 3.

More particularly from illustration of FIG. 3 it is clear that such coupling allows to generate two flows of compressed air in each intermediate chamber 31, 32 starting from the single flow coming from the outlet 6 and generated by the compressor 2.

In this way a short and symmetric channel of air connection between compressor 2 and acoustic chambers 7, 8 is obtained, warranting optimal sound instantaneousness and in the bi-tonal case of the drawings contemporaneousness.

According to the invention the compressor unit 2 and the sound wave generator unit 3 are mechanically connected through a collar generally indicated with numeral 34.

Said flange 34 as better shown in FIG. 4, is made as an integral extension of the two shells 15, 16 like two portions 34*a* and 34*b* having a generally semicircular shape adapted to receive the body of compressor 2 that has generally a cylindrical shape.

Obviously the shape of the two portions 34*a* and 34*b* may be different in other embodiments and fit to the shape of the body of compressor 2.

On collar 34, and more particularly on the portion 34*b* on the side where the suction inlet 5 is arranged, there is a suction duct 35, having a labyrinth configuration and putting the suction inlet 5 in communication with the outside.

In said suction duct 35 there is also a projecting tubular member 36 which is received inside the suction inlet 5 and is provided with elastically expanding means 37 interfering with said the suction inlet 5 to make the connection of the collar 34 and particularly of its portion 34*b* to the body of compressor 2 warranting a better adhesion of the suction duct 35 of said compressor 2.

As shown in FIG. 4 each acoustic chamber 7, 8 is defined by a shaped body 7*a*, 8*a* applied to the corresponding outer shell 15, 16.

The elastic membrane 11, 12 is constrained to the shaped body 7*a*, 8*a* through a metal bottom 38, 39 superimposed externally and fixed by flanging to the shaped body 7*a*, 8*a* in order to tension the membrane during the calibration phase as a function of the level of sound pressure to be propagated.

A cap 40, 41 coupled to the shaped body 7*a*, 8*a* by mechanical fit is arranged as a cover and protection of bottom 38, 39.

As shown in FIG. 1 on the body of the compressor 2 there are also fastening means 42 consisting of a shaped projecting member adapted to receive screw elements for connection of the acoustic horn 1 to a support structure S.

It is clear that such fastening means 42 in other embodiments may be different to match shape and position of the support structure S.

Finally and as shown in FIG. 5, the diaphragm 17 is provided with hooking snap means 17*a* adapted to constrain said diaphragm 17 to the compressor unit 2 and to warrant the pneumatic seal when the compressor 2 and the sound wave generator 3 are mutually joined by collar 34 and the injector 29 is fully inserted into the duct 33 made on said diaphragm 17.

Indeed, the acoustic horn 1 may be advantageously supplied as a kit with the parts consisting of the compressor unit 2 and the sound wave generator 3 divided, that can be easily assembled by the user before installation by snapping.

The assembling operation is carried out by inserting the injector 29 of the compressor unit 2 into the duct 33 of the diaphragm 17 for such a length as to allow the snap means 17*a* to constrain the diaphragm 17 to the body of the compressor unit 2 warranting the pneumatic seal as well.

At the same time the collar 34 through its portions 34*a* and 34*b* is coupled by mechanical fit with the outer surface of the compressor unit 2.

Finally insertion of the tubular projecting member 36 into the suction inlet 5 through the expanding means 37 warrants a further fastening of collar 34 to the compressor.

The labyrinth suction duct 35 allows protection of the air suction inlet 5 from possible foreign matter and water splash that instead may enter directly inside the compressor unit 2.

Figure 10:
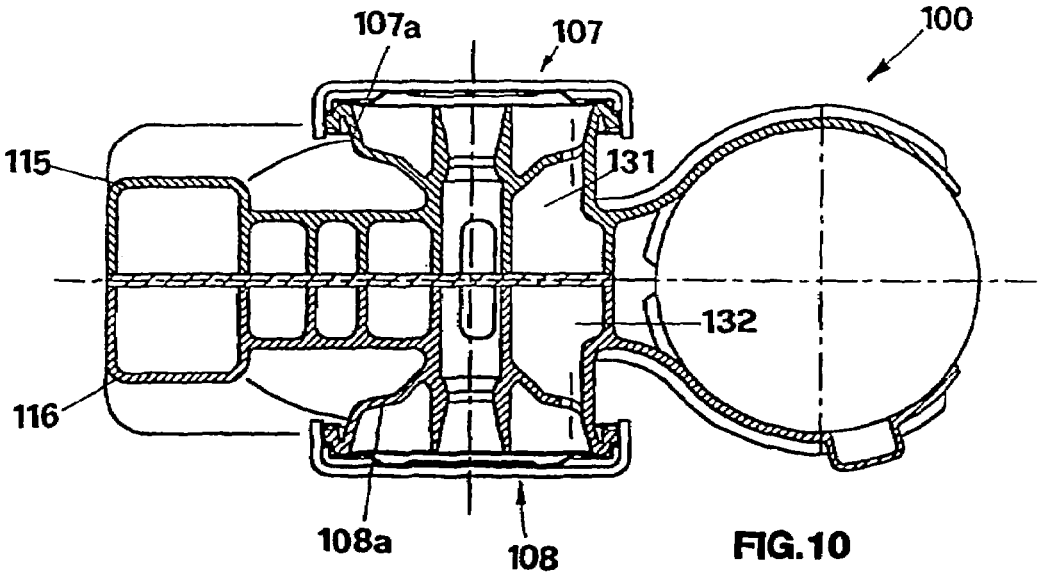
FIG. 10 is a sectional view taken along line I—I of a constructional variation of FIG. 1.

A first embodiment of the acoustic horn is shown in FIG. 10 and is generally indicated with numeral 100.

This modification differs from the first embodiment in that the shaped body 107*a*, 108*a* of each chamber 107, 108 is integral with the corresponding outer shell 115, 116, the whole being made by moulding.

In this embodiment each intermediate chamber 131, 132 will obviously have a different shape relative to the first embodiment of FIG. 4.

Figure 11:
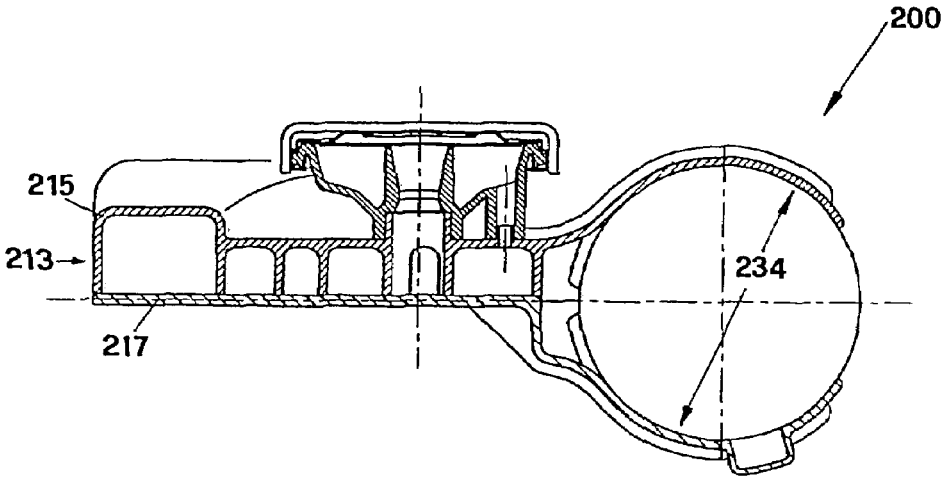
FIG. 11 is a sectional view taken along line I—I of another constructional variation of FIG. 1.

Another embodiment of the invention is shown in FIG. 11 and is generally indicated with numeral 200.

This modification relates more particularly to a monotonal acoustic horn obviously having a single acoustic duct 213 as a single sound wave should be propagated.

Figure 12:
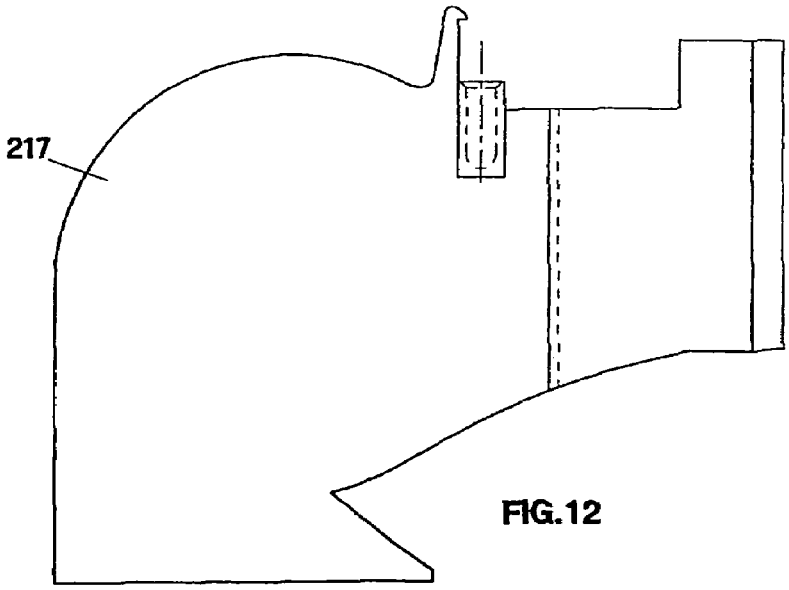
FIG. 12 is a side view of the diaphragm of FIG. 11.
Figure 14:
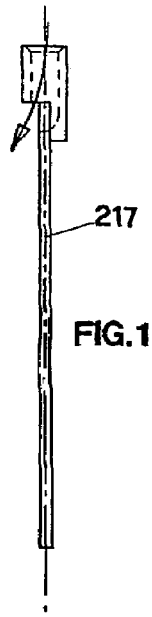
FIG. 14 is a side view of the diaphragm of FIG. 12.
Figure 13:
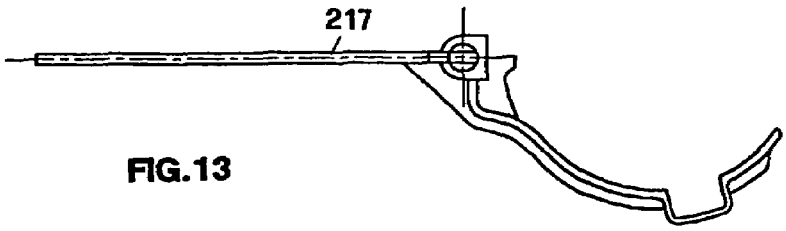
FIG. 13 is a top view of the diaphragm of FIG. 12.

In this case, since there is a single outer shell 215, the connection collar 234 is made in two parts, a first part as extension integral with the outer shell 215 and a second part integral with the diaphragm 217 as shown in detail in FIGS. 12 and 13.

Figure 15:
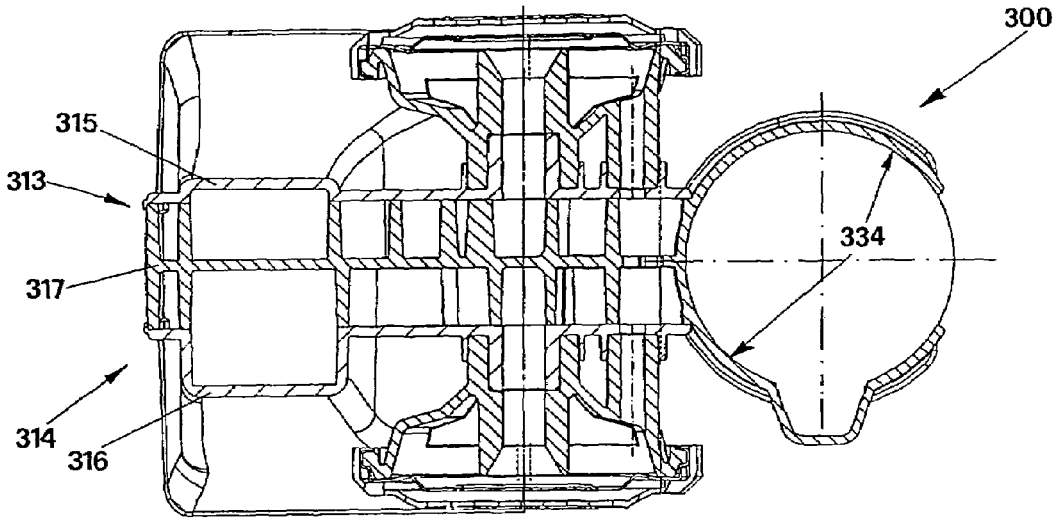
FIG. 15 is a sectional view taken along line I—I of a further constructional variation of FIG. 1.

A further embodiment of the invention is shown in FIG. 15 and is indicated as a whole with 300.

It relates to a bi-tonal acoustic horn provided with two acoustic ducts 313, 314 which, as in the realization of FIG. 1, are defined between the two opposed shells 315, 316 and the diaphragm 317.

Figure 16:
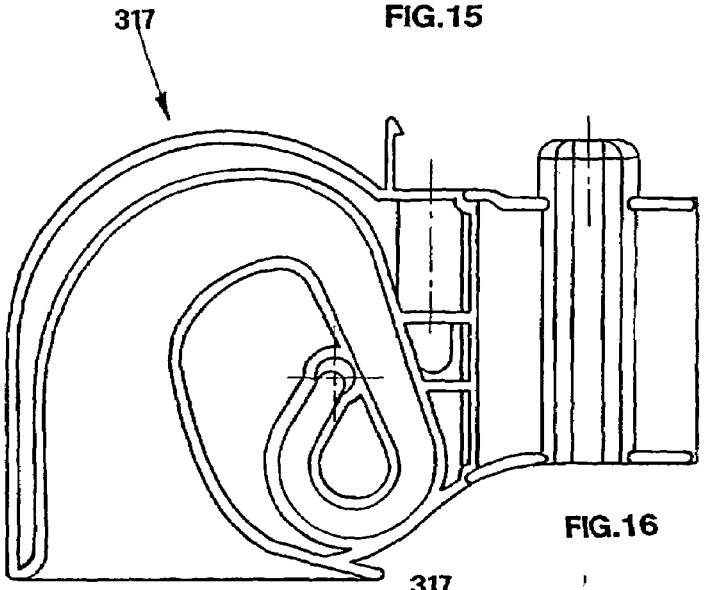
FIG. 16 is a lateral view of the diaphragm of FIG. 15.
Figure 17:
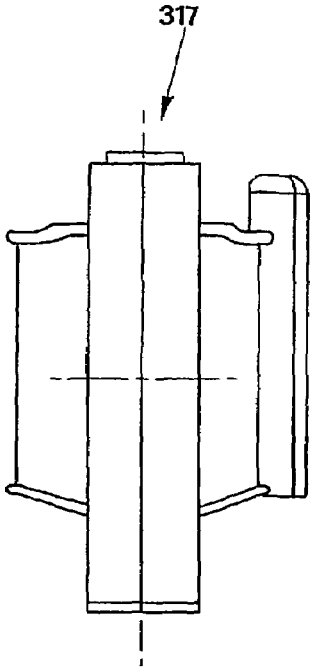
FIG. 17 is a top view of FIG. 16.
Figure 18:
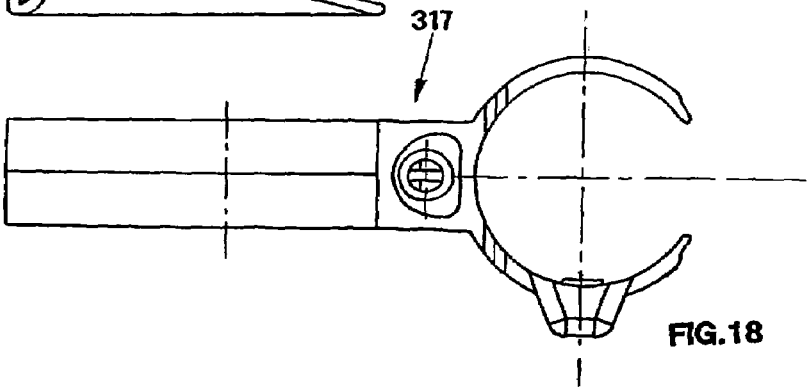
FIG. 18 is a lateral view of FIG. 16.

However, in this case the collar 334 is made integral with the diaphragm 317. Said diaphragm also presents the walls of the acoustic ducts 313, 314, as it can be seen in FIGS. 16 and 18.

The two shells 315 and 316 are preferably, but not necessarily, connected to the diaphragm 317 through glueing or ultrasound welding.

The bi-tonal horns of the invention can be associated to sound modulation systems, which are not shown in the figures, allowing sounds production with different melodies.

In particular, it is possible to alternate the duration and the intensity of the air flow in the ducts, in order to obtain different acoustic effects.

This can be obtained, according to the known techniques, through the interposition of controlled valve means allowing the control and the convey of the air flow from the compressor unit towards the two acoustic ducts.

A first of such known techniques relates to the use of an electrovalve connected to an electronic control unit that determines the position of the electrovalve in order to convey and to modulate the air flow in the ducts.

According to another known technique, the distribution of the air flow towards the acoustic ducts is obtained through a gear mechanic system which controls the valve according to the desired flow. Said gear mechanic system is connected to the driving shaft associated to the compressor unit by reducing means.

From the foregoing it is clear that the acoustic horn of the invention attains the intended objects and advantages.

Other constructional modifications may be made to the acoustic horn in the execution phase.

More particularly the configuration of the labyrinth suction duct and the intermediate chambers, shape and extension of the collar, shape and position of the support fastening means or of the diaphragm snap hooking means may be different.

It is however to be understood that such variations as well as further modifications neither described nor illustrated in the drawings, whenever falling within the inventive scope indicated in the appended claims, are to be considered covered by the present patent.

The invention claimed is:

1. An electropneumatic acoustic horn (1; 100; 200; 300) comprising:

at least an electric compressor unit (2) provided with at least a suction inlet (5) of air from outside and at least an outlet (6) for the compressed air;

a sound wave generator (3) comprising at least an acoustic chamber (7, 8; 107, 108) provided with at least an opening (9, 10) for introduction of pressurised air, an elastic membrane (11, 12) being provided in said opening for sound generation and at least a volute wound acoustic duct (13, 14; 213; 313; 314) defined between an outer shell (15, 16; 115, 116; 215; 315; 316) and a diaphragm (17; 217; 317), said acoustic duct (13, 14; 213; 313; 314) being in communication with said acoustic chamber (7, 8; 107, 108) and adapted to propagate to the outside the sound produced by said membrane (11, 12);

air channelling means (4) adapted to put said outlet (6) of said the compressor (2) in communication with said opening (9, 10) of said the acoustic chamber (7, 8; 107, 108);

characterized in that said at least a compressor unit (2) and said sound wave generator (3) are mechanically connected in a removable way by fitting slidingly a collar (34; 234; 334).

2. The acoustic horn (1; 100; 200; 300) according to claim 1, characterized in that said collar (34; 234; 334) belongs to said sound wave generator (3).

3. The acoustic horn (1; 100) according to claim 2, characterized in that said sound wave generator comprises two acoustic ducts (13; 14) defined between two shells (15; 16; 115; 116) one opposed with another and separated by a diaphragm (17), a portion (34*a*; 34*b*) of said collar (34) being made in each one of said shells (15; 16; 115; 116).

4. The acoustic horn (200) according to claim 2, characterized in that said sound wave generator comprises a single acoustic duct (213) defined between a shell (215) and a diaphragm (217), said collar (234) having a portion integral with said shell (215) and a portion integral with said diaphragm (217).

5. The acoustic horn (300) according to claim 2, characterized in that said sound wave generator comprises two acoustic ducts (313, 314) defined between two shells (315, 316) one opposed with another and separated by a diaphragm (317), said collar (334) being made integral in said diaphragm (317).

6. The acoustic horn (1; 100; 200; 300) according to claim 1, characterized in that said collar (34; 234; 334) has a labyrinth suction duct (35) putting said suction inlet (5) of said compressor (2) in communication with the outside.

7. The acoustic horn (1; 100; 200; 300) according to claim 1, characterized in that said channelling means (4) comprise:

an injector (29) belonging to said compressor (2) and arranged after said outlet (6);

at least an intermediate chamber (31; 32; 131; 132), defined in said sound wave generator (3) in which said the opening (9, 10) of communication with said acoustic chamber (7,8; 107, 108) is defined;

a duct (33) made in said diaphragm (17) communicating with said intermediate chamber (31, 32, 131, 132) and coupled with said injector (29).

8. The acoustic horn (1; 100; 200; 300) according to claim 1, characterized in that said diaphragm (17; 217) is provided with hooking snap means (17*a*) adapted to constrain said diaphragm (17; 217) to the body of said compressor and to warrant the pneumatic seal when said collar (34; 234) mutually connects said compressor (2) and said sound wave generator (3).

9. The acoustic horn (1; 100; 200; 300) according to claim 6, characterized in that in said duction duct (35) there is a projecting tubular member (36) received inside said the suction inlet (5) and provided with elastically expanding means (37) interfering with said suction inlet (5) to obtain connection of said collar (34; 234; 334) to the body of said compressor (2).

10. The acoustic horn (1; 100; 200; 300) according to claim 1, characterized in that said volute wound acoustic duct (13; 14, 213) comprises a first stretch (19, 20) with generally constant section provided with an inlet (21, 22) communicating with said acoustic chamber (7, 8; 107, 108) connected with a second stretch (23, 24) having a section varying with a generally conic exponential law and provided with an outlet (27, 28) for sound propagation to the outside.

11. The acoustic horn (1; 100; 200; 300) according to claim 1, characterized by comprising fastening means (42) to a support structure (S).

12. The acoustic horn (1; 100; 200; 300) according to claim 11, characterized in that said fastening means comprise a single shaped projecting member (42) made in the body of said compressor (2), adapted to receive screw members for connection to said support structure (S).

13. The acoustic horn (1; 100; 200; 300) according to claim 1, characterized in that said acoustic chamber (7, 8; 107, 108) is defined by a hollowed shaped body (7*a*, 8*a*; 107*a*, 108*a*) in which said elastic membrane (11, 12) is arranged, associated to said outer shell (15, 16; 115, 116) defining said acoustic duct (13, 14; 213; 313, 314).

14. The acoustic horn (1; 100; 200; 300) according to claim 13, characterized in that said shaped body (7*a*, 8*a*) is applied to said outer shell (15, 16; 215).

15. The acoustic horn (100) according to claim 13, characterized in that said shaped body (107*a*, 108*a*) is a single body integral with said outer shell (115, 116).

16. The acoustic horn (100) according to claim 15, characterized in that said shaped body (107*a*, 108*a*) and said outer shell (115, 116) are made by moulding.

17. The acoustic horn (11; 100; 200; 300) according to claim 13, characterized in that said elastic membrane (11, 12) is constrained to said shaped body (7*a*, 8*a*; 107*a*, 108*a*) through a metal bottom (38, 39) superimposed externally and flanged to said shaped body (7*a*, 8*a*; 107*a*, 108*a*) in order to tension said membrane (11, 12) as a function of the level of pressure of the sound to be propagated.

18. The acoustic horn (1; 100; 200, 300) according to claim 17, characterized by comprising a cap (40, 41) arranged as a cover for said bottom (38, 39) and coupled by mechanical fit with said shaped body (7*a*, 8*a*; 107*a*, 108*a*).

19. The acoustic horn (1; 100; 200; 300) according to claim 1, characterized by comprising valve means associated to control means to vary the air flow from said compressor (2) to said acoustic ducts (13, 14; 313, 314).

20. The acoustic horn (1; 100; 200; 300) according to claim 19, characterized in that said control means are electronical means.

21. The acoustic horn (1; 100; 200; 300) according to claim 19, characterized in that said control means are mechanical means.

* * * * *